United States Patent [19]

Ueda

[11] Patent Number: 4,872,773

[45] Date of Patent: Oct. 10, 1989

[54] PRINTING WHEEL DISCRIMINATING APPARATUS

[75] Inventor: Hiroyuki Ueda, Yokohama, Japan

[73] Assignee: Canon Kabushiki Kaisha, Tokyo, Japan

[21] Appl. No.: 320,906

[22] Filed: Mar. 8, 1989

Related U.S. Application Data

[63] Continuation of Ser. No. 113,433, Oct. 28, 1987, abandoned, and Ser. No. 804,896, Dec. 5, 1985, abandoned.

[30] Foreign Application Priority Data

Dec. 10, 1984 [JP] Japan ..... 59-259192

[51] Int. Cl.[4] ..... B41J 1/30

[52] U.S. Cl. ..... 400/144.2; 400/171; 400/175

[58] Field of Search ..... 400/144.2, 144.3, 174, 400/175, 149–151.1, 171; 101/93.11, 93.19

[56] References Cited

U.S. PATENT DOCUMENTS

| | | | |
|---|---|---|---|
| 4,074,798 | 2/1978 | Berger | 400/144.3 |
| 4,118,129 | 10/1978 | Grundherr | 400/144.2 |
| 4,209,262 | 6/1980 | Sauage | 400/144.2 |
| 4,281,938 | 8/1981 | Phillips | 400/175 X |
| 4,385,847 | 5/1983 | Avison | 400/144.2 |
| 4,541,746 | 9/1985 | Bobart | 400/144.2 |

FOREIGN PATENT DOCUMENTS

| | | | |
|---|---|---|---|
| 100084 | 12/1980 | Japan | 400/144.2 |

*Primary Examiner*—Paul T. Sewell

*Attorney, Agent, or Firm*—Fitzpartick, Cella, Harper & Scinto

[57] ABSTRACT

A printing wheel discriminating apparatus comprises a driving device for driving a printing wheel in units of predetermined angles, a detecting device for detecting identification data attached to a specific position of the printing wheel, and a storing device for storing presence/absence data of the identification data corresponding to the specific position of the printing wheel based on the output from the detecting device, thereby discriminating the type of printing wheel.

5 Claims, 5 Drawing Sheets

| ANGLE | A2 | A1 | A0 | |
|---|---|---|---|---|
| 0° | 0 | 0 | 0 | b0 (HOME POSITION) |
| 45° | 0 | 0 | 1 | b1 |
| 90° | 0 | 1 | 0 | b2 |
| 135° | 0 | 1 | 1 | b3 |
| 180° | 1 | 0 | 0 | b4 |
| 225° | 1 | 0 | 1 | b5 |
| 270° | 1 | 1 | 0 | b6 |
| 315° | 1 | 1 | 1 | b7 |

PRINTING WHEEL DISCRIMINATING APPARATUS

This application is a continuation of application Ser. No. 113,433 filed Oct. 28, 1987 and parent application Ser. No. 804,896 filed Dec. 5, 1985, both abandoned.

BACKGROUND OF THE INVENTION

1. Field of the Invention

The present invention relates to a printing wheel discrimination apparatus which automatically discriminates types of printing wheels.

2. Description of the Prior Art

Printers or typewriters using a printing wheel can print with various fonts by exchanging printing wheels. A control device installed in a printer or a typewriter must discriminate the type of font of the exchanged printing wheel. That is, in order to set optimum control conditions required for printing (e.g., an optimum printing pressure suitable for a font to be printed), the type of the mounted printing wheel must be determined.

In conventional methods for discriminating the type of a printing wheel, precise encoded data is recorded on a printing wheel, or short pulses from a reference position to a specific mark are counted for detecting the specific mark.

In this manner, in the conventional technique, precise machining technique and complicated hardware are required, and manufacturing cost undesirably increases.

SUMMARY OF THE INVENTION

The present invention has been made in consideration of the above situation, and has as its object to provide a printing wheel discrimination apparatus which enables automatic discrimination of a printing wheel with a simple structure.

The above and other objects of the present invention will be apparent from the following description.

DETAILED DESCRIPTION OF THE PREFERRED EMBODIMENT

An embodiment of the present invention will be described in detail.

Figure 1A:
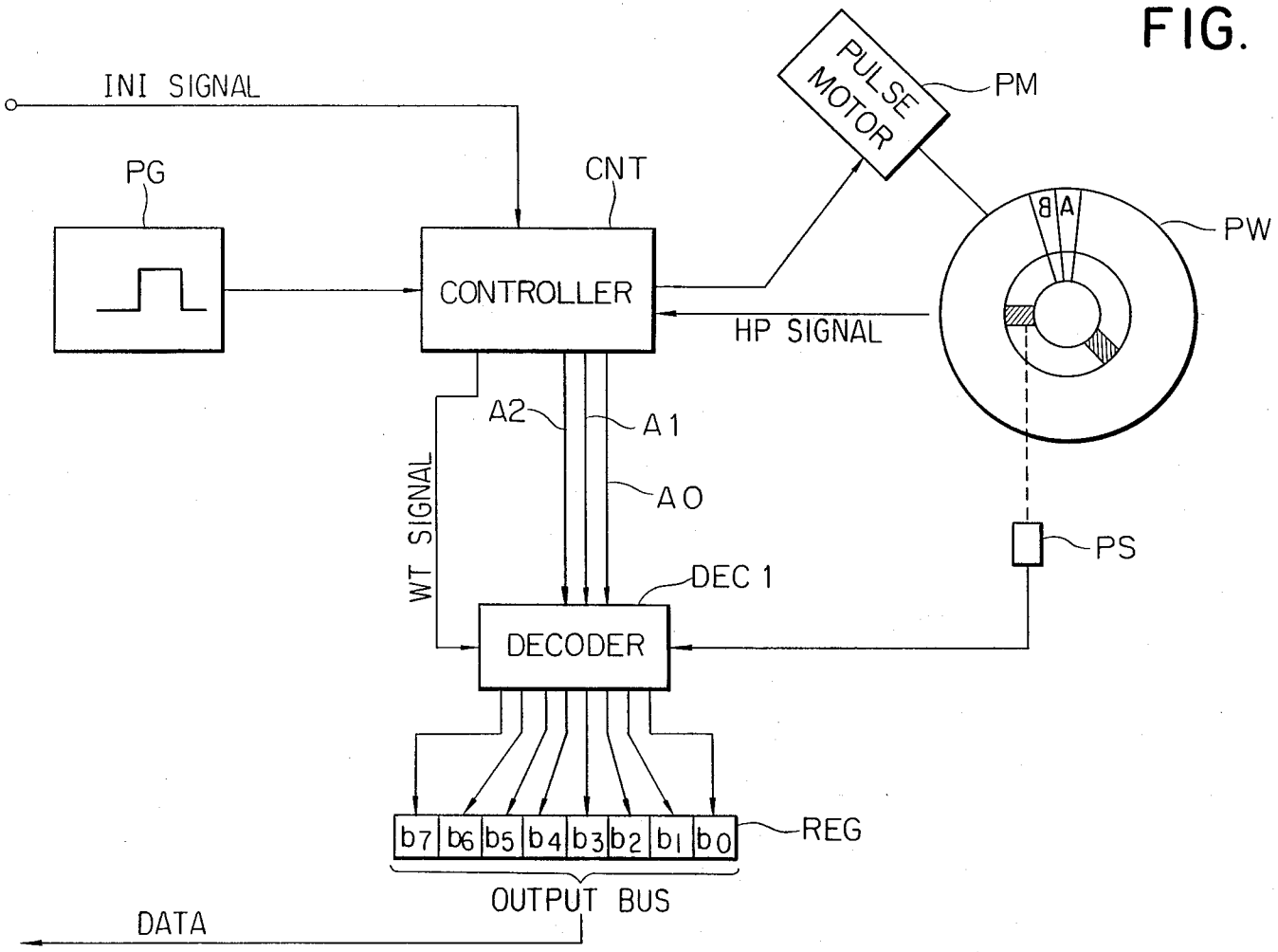
FIGS. 1A and 1B are block diagrams showing an embodiment of the present invention.

FIG. 1A is a block diagram showing an embodiment of the present invention. Referring to FIG. 1A, a pulse generator PG is connected to a controller CNT which has a memory storing program of a control sequence shown in FIG. 4, and performs a control operation in accordance with the control sequence. A decoder DEC1 connected to the controller CNT is connected to a register REG, and is also connected to a photosensor PS. A pulse motor PM connected to the controller CNT is coupled to a printing wheel PW. These components are enabled upon reception of an initialization signal INI from an external device (e.g., a printer or typewriter main body), and generate data for specifying the type of a printing wheel (discrimination result) onto an output bus. The data signal indicating the discrimination result is processed by a circuit shown in FIG. 1B.

Figure 1B:
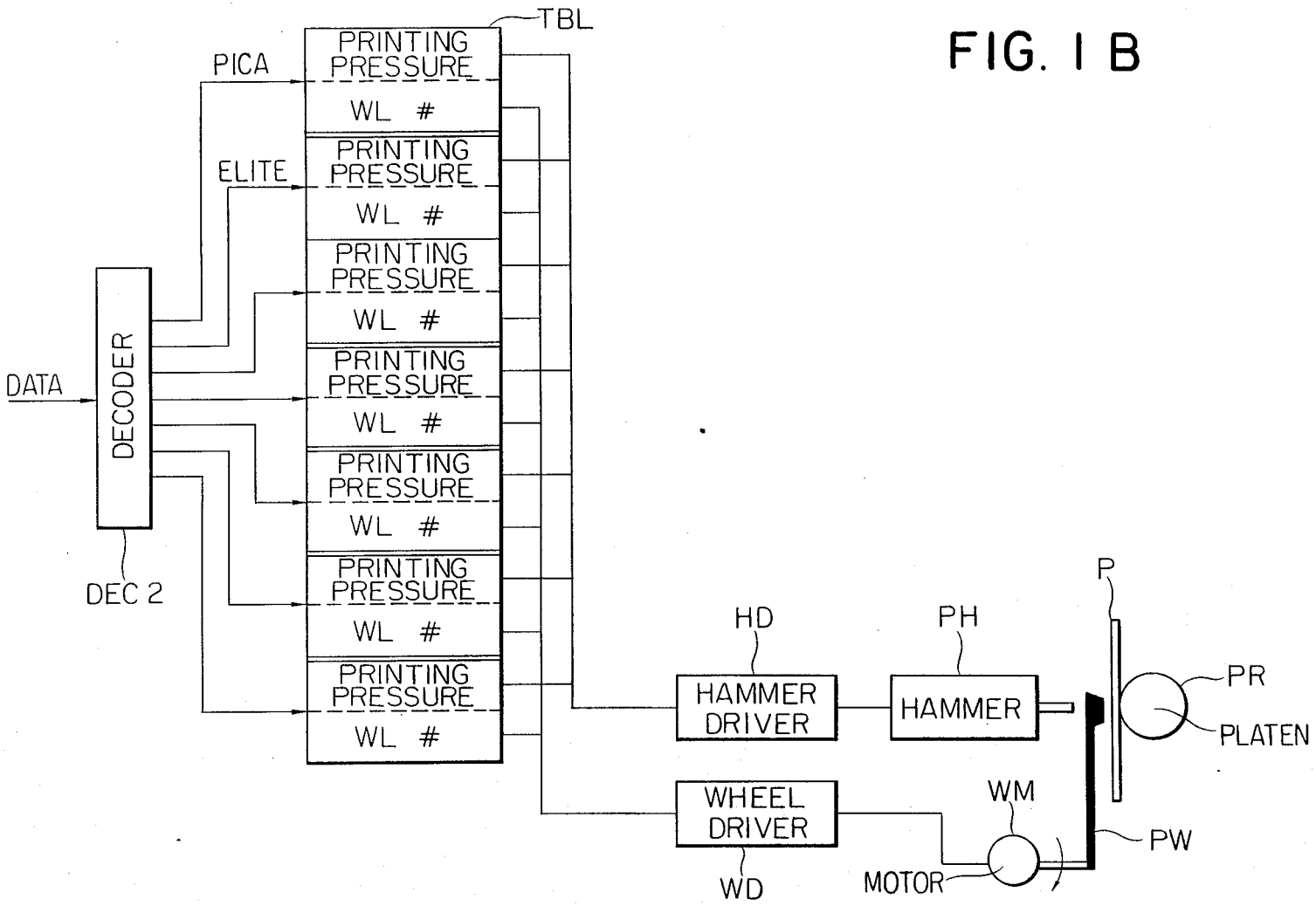

Referring to FIG. 1B, a decoder DEC2 receives output data from the register REG shown in FIG. 1A, and sends a wheel discrimination signal. A table memory TBL stores data (e.g., a printing wheel, a font number etc.) associated with a plurality of wheels (e.g., pica, elite, etc.) and is accessed in accordance with the output from the decoder DEC2. A hammer driver HD drives a printing hammer PH. A wheel driver WD rotates or stops a wheel motor WM in accordance with the font number. The apparatus also comprises a recording paper sheet P and a platen PR. When the output signal from the register REG is discriminated by the decoder DEC2, printing control suitable for the current printing wheel can be performed based on the data at a predetermined address of the table memory TBL.

Figures 2, 3:
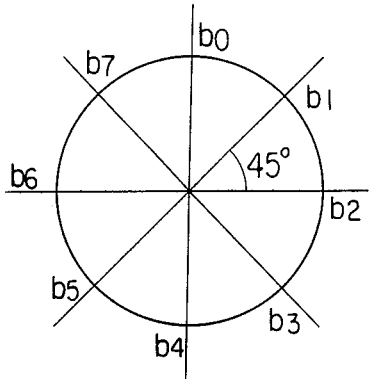
FIG. 2 is an illustration indicating positions of marks attached to a printing wheel.
FIG. 3 is a table showing the relationship between wheel rotational angles and truth values of an address signal.
Figure 4:
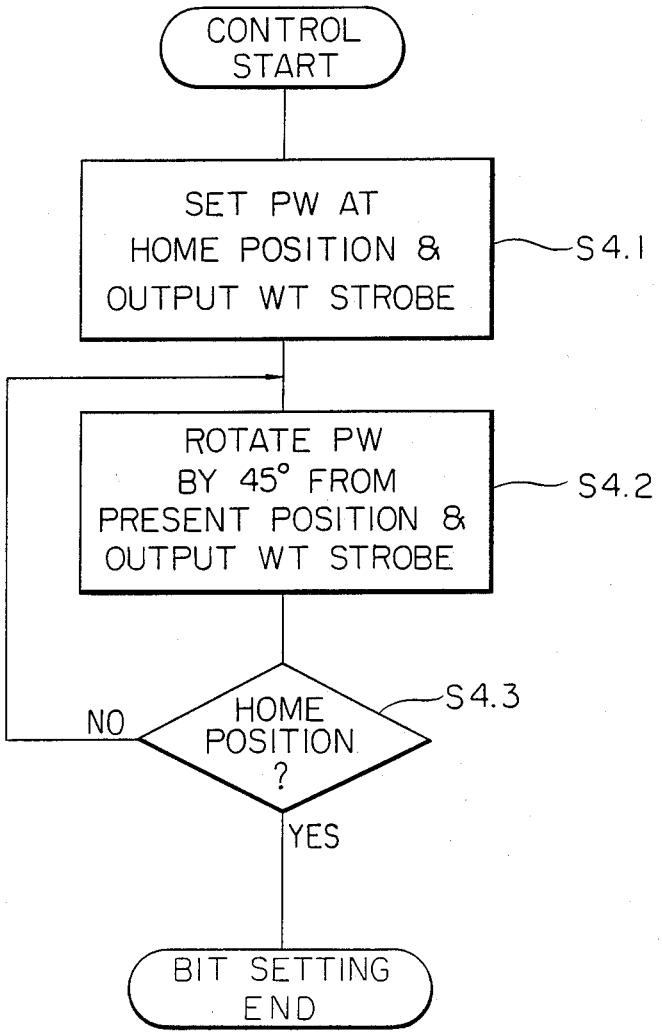
FIG. 4 is a flow chart showing the control sequence to be executed by a control device.
Figure 5:
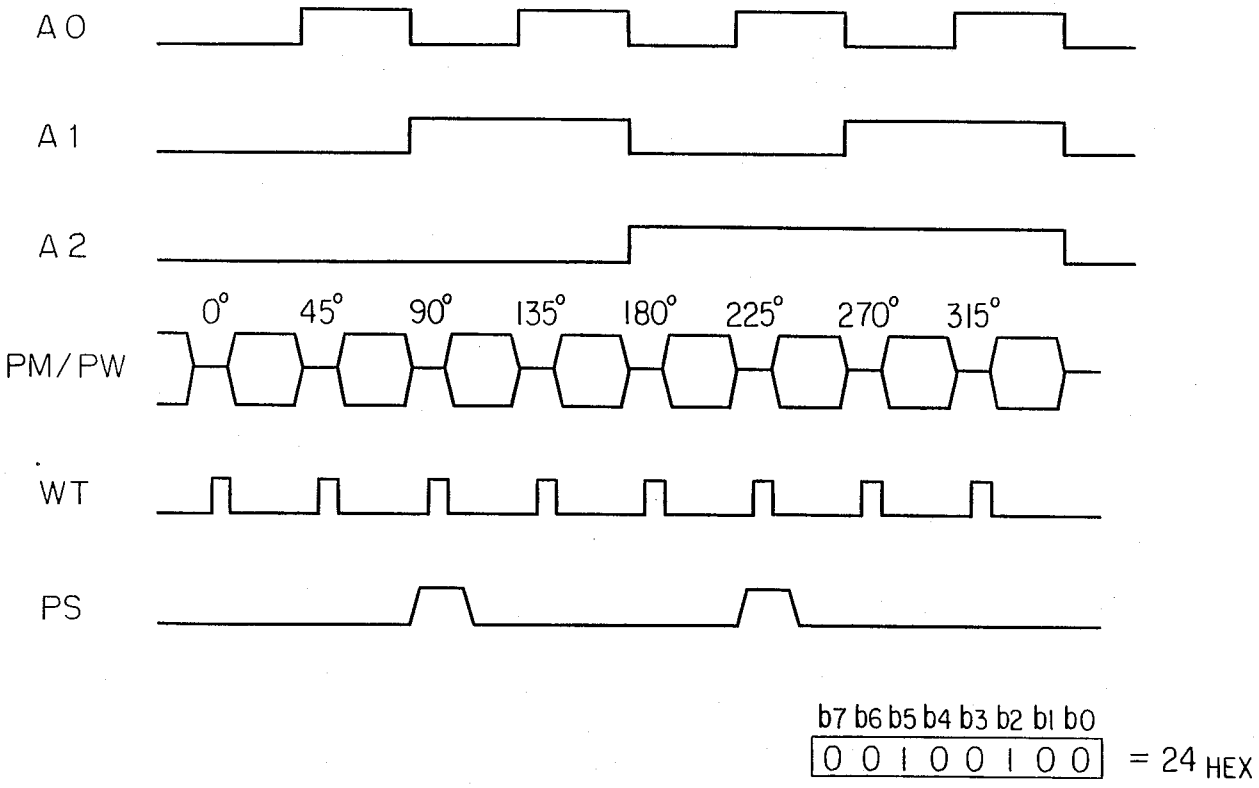
FIG. 5 is a timing chart for explaining the operation of this embodiment.

FIG. 2 shows positions of marks attached to the printing wheel, and FIG. 3 shows the relationship between the addresses input to the decoder DEC1 and the wheel rotational angles. FIG. 4 is a flow chart showing a control sequence of this embodiment, and FIG. 5 is a timing chart of this embodiment.

The operation of this embodiment will be described with reference to FIGS. 1 to 5.

The marks as identification data indicating the type of font are attached to any ones of 45°- divided positions. In this case, the angle 45° is sufficiently large as compared to a pitch angle of type faces of the printing wheel. The mark can simply be marked with white paint, and does not require particularly high positional precision.

Upon reception of the initialization signal INI, the controller CNT rotates the pulse motor PM while generating address signals A0, A1, and A2. When the motor PW is stopped, the controller CNT sends a write signal WT to the decoder DEC1. The flow chart in FIG. 4 shows this sequence.

In step S4.1, the printing wheel PW is set at a predetermined position based on a home position signal HP from the printing wheel PW side. At the same time, the write signal WT strobe is generated. In this case, all the address signals A0, A1 and A2 are logic "0", as shown in FIG. 3.

The control sequence advances to step S4.2, and the printing wheel PW is rotated by 45°.

In this case, when the printing wheel PW is stopped, the write signal WT is also generated as in step S4.1.

In step S4.3, it is checked if control of step S4.2 has been repeated seven times. Upon this checking, it can be detected if the printing wheel PW is stopped at the home position. In other words, when the home position signal HP is checked, "YES" or "NO" can be determined in the same manner as in step S4.1.

Meanwhile the decoder DEC1 receives the output signals from the controller CNT and the photosensor PS, and selects any of bits b0 to b7 included in the register REG based on the data on address lines A0, A1, and A2. The decoder DEC1 stores at the selected bit position the logic level "0" or "1" of the signal generated from the photosensor PS in synchronism with the write signal WT.

For example, when marks (indicated by hatched areas) are attached to 90° and 225° positions as in the printing wheel PW shown in FIG. 1A, the controller CNT stores logic "1" in the bits b2 and b5 by open loop control described above, as shown in the timing chart in FIG. 5. FIG. 5 shows the address signals A0, A1 and A2, a state of the printing wheel PW, the write signal WT, and output level of the photosensor PS when the write signal WT is at logic "1". When the printing wheel PW is rotated by 90° and 225°, respectively, logic "1" is written in the bits b2 and b5, and otherwise, logic "0" is written.

In this embodiment, since the 1-byte (8 bit) register REG is used, 256 types of printing wheels can be specified.

As described above, according to this embodiment, encoded marks are detected while rotating the printing wheel PW, thus setting/resetting the corresponding bits of a storage device (i.e., the register). Thus, the marks need not be attached to the printing wheel with particularly high positional precision, and hardware can be manufactured with low cost.

In particular, since a pulse counter using the conventional technique for identification is not required in the present invention, not only the number of parts but also the frequency of problems may be greatly reduced.

I claim:

1. A printing wheel discriminating apparatus for discriminating a printing wheel having a plurality of areas for identifying data, a plurality of type faces around a rotating outer area thereof at specific angles and a reference position, comprising:

driving means for rotating said printing wheel, said driving means rotating said printing wheel stepwisely during the wheel discriminating process, with the angle of each stepwise rotation being larger than said specific angles and the entire periphery of said printing wheel being equally divided into predetermined angles which correspond to the angle of each stepwise rotation;

detecting means for detecting said area provided on said printing wheel;

a first transferring line for transferring a result of detection by said detecting means;

a second transferring line, independent from said first transferring line, for transferring a reference signal representing the reference position of said printing wheel;

memory means for storing the result of detection by said detecting means at each predetermined angular position, said memory means containing a number of memory areas corresponding to a number of said areas, and storing said identifying data, if present;

control means for rotating said printing wheel in units of predetermined angles on the basis of the reference signal transferred through said second transferring line, and outputting the contents of said memory as identifying data; and means for defining a printing position of said printing wheel, based on the identifying data output from said control means.

2. A printing wheel discriminating apparatus according to claim 1, said control means further comprising first decoding means for designating an address of said memory means by an address signal generated by said control means in response to the rotation of said pulse motor starting from said reference position.

3. A printing wheel discriminating apparatus according to claim 2, wherein said address signal is generated corresponding to the detection of each of said areas, and said control means generates a write signal in accordance with each address value.

4. A printing wheel discriminating apparatus according to claim 2, said defining means further comprising second memory means which includes data for printing pressure of a plurality of the printing wheels, and second decoding means for selecting data in said second memory means in accordance with identifying data stored in said memory means.

5. A printing wheel discriminating apparatus according to claim 1, wherein said control means initiates a discriminating operation of said printing wheel by detection of said reference position and finishes said discriminating operation by detection of said reference position.

* * * * *

UNITED STATES PATENT AND TRADEMARK OFFICE

CERTIFICATE OF CORRECTION

PATENT NO. : 4,872,773

DATED : October 10, 1989

INVENTOR(S) : Hiroyuki Ueda

It is certified that error appears in the above-identified patent and that said Letters Patent is hereby corrected as shown below:

On the title page, item:

[56] References Cited:

U.S. PATENT DOCUMENTS:

"Sauage" should read --Savage--.

FOREIGN PATENT DOCUMENTS:

"100084 12/1980 Japan" should read
--100084 6/1982 Japan--.

ATTORNEY, AGENT, OR FIRM:

"Fitzpartick, Cella, Harper & Scinto" should read
--Fitzpatrick, Cella, Harper & Scinto--.

COLUMN 2:

Line 39, "motor PW" should read --motor PM--.

UNITED STATES PATENT AND TRADEMARK OFFICE

CERTIFICATE OF CORRECTION

PATENT NO. : 4,872,773 Page 2 of 2

DATED : October 10, 1989

INVENTOR(S) : Hiroyuki Ueda

It is certified that error appears in the above-identified patent and that said Letters Patent is hereby corrected as shown below:

COLUMN 3:

Line 11, "(8 bit)" should read --(8-bit)--.

Line 40, "area" should read --areas--.

COLUMN 4:

Line 23, "said" should be --a--.

Signed and Sealed this

Twenty-sixth Day of August, 1997

*Attest:*

Bruce Lehman

BRUCE LEHMAN

*Attesting Officer*

*Commissioner of Patents and Trademarks*